United States Patent [19]

Adams

[11] 4,194,742

[45] Mar. 25, 1980

[54] LAND AND SEA WAR GAME APPARATUS

[76] Inventor: Ezra J. Adams, 15818 Davis Cup La., Ramona, Calif. 92065

[21] Appl. No.: 929,572

[22] Filed: Jul. 31, 1978

[51] Int. Cl.[2] ..... A63F 3/00

[52] U.S. Cl. ..... 273/265

[58] Field of Search ..... 273/265, 267

[56] References Cited

U.S. PATENT DOCUMENTS

| | | | |
|---|---|---|---|
| 429,250 | 6/1890 | Sperl | 273/267 |
| 1,932,524 | 10/1933 | Jackson | 273/265 X |
| 2,058,079 | 10/1936 | Heath | 273/265 |
| 3,343,840 | 9/1967 | Winters | 273/265 |
| 3,353,829 | 11/1967 | Board | 273/265 X |
| 3,460,834 | 8/1969 | Nickel | 273/267 X |

FOREIGN PATENT DOCUMENTS

| | | | |
|---|---|---|---|
| 999275 | 10/1951 | France | 273/265 |

*Primary Examiner*—Harland S. Skogquist
*Attorney, Agent, or Firm*—Knox & Knox

[57] ABSTRACT

A war game for two opponents each having an assembly including a playboard hidden from the opponent by a shield board, both boards having a grid of target-receiving sockets identified by co-ordinates, the playboard representing an expanse of water and additional sockets therein locating relatively large platforms representing land masses so that playing piece targets, arbitrarily placed on said platforms, themselves arbitrarily placed, are still co-ordinately identified enabling shots, misses and hits on land, sea and targets to be called, and a rack for hit targets, visible to the opponent, is provided on each shield board. The playing piece targets, aside from ships and mines, include units associated with land masses such as fuel and water depots and negative-counting targets such as churches and hospitals. A spinner is provided to indicate for each opponent the number of shots per turn and this unique spinner also determines, by being color coded, whether the shots for a particular "turn" of a player must be called as falling on land or on water and this results in the element of skill in playing the game being heightened.

8 Claims, 4 Drawing Figures

FIG. 1
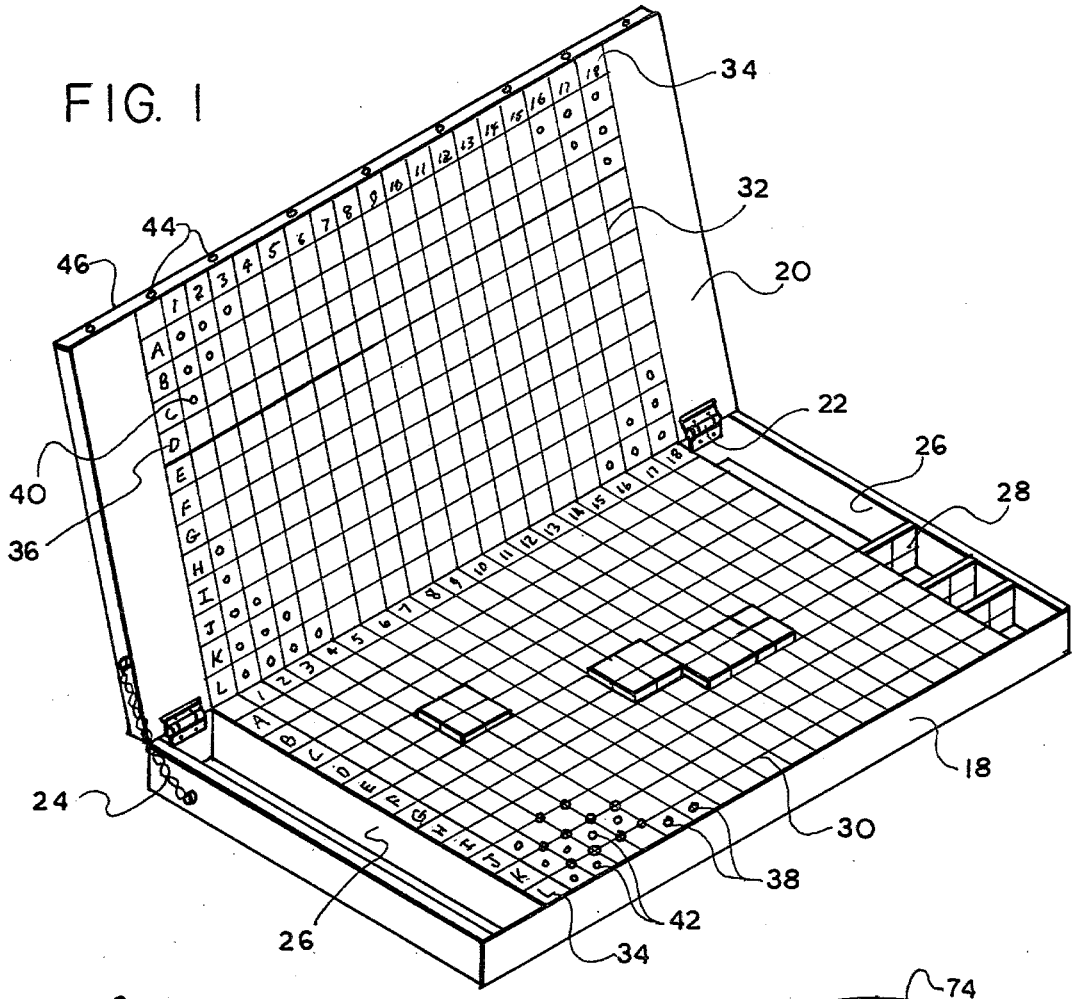
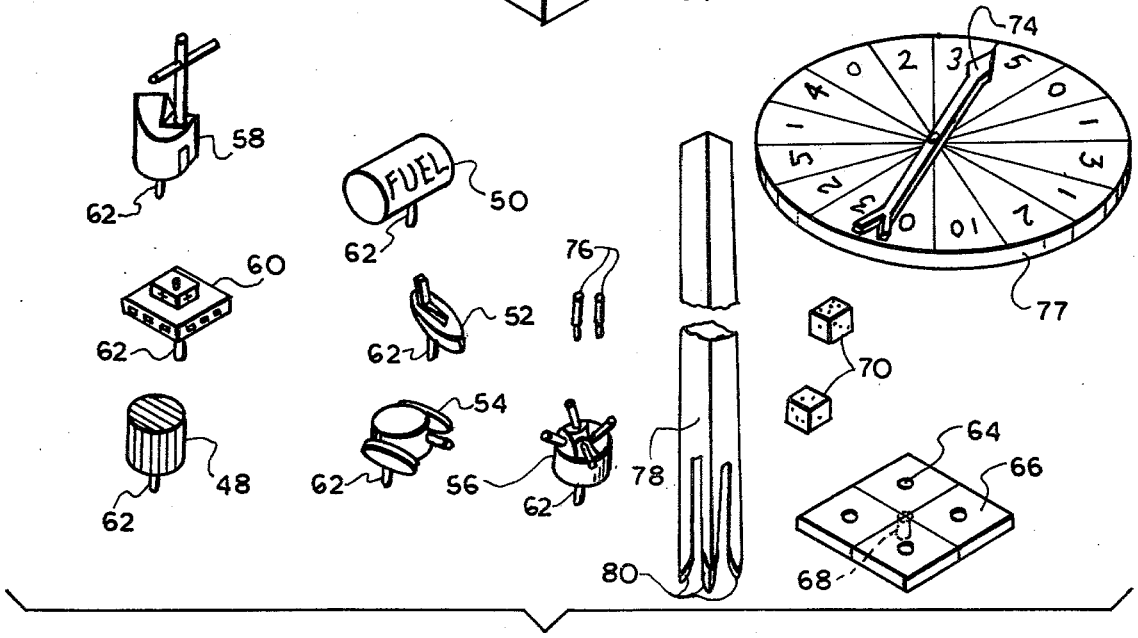
FIG. 2

LAND AND SEA WAR GAME APPARATUS

BACKGROUND OF THE INVENTION

Many war games have been developed and a number have been patented both in United States and foreign countries. A popular game merchandised under the mark BATTLESHIP employs boards screened from opposing players with co-ordinate location of targets, which targets as in another similar game called SALVO are arbitrarily deployed ships, there being no land masses or differentiation of shots in these games of chance. The U.S. Pat. No. 1,932,524 features screened boards in a special hinging arrangement and a more recent domestic U.S. Pat. No. 3,545,761 employs similar structure in a word game. Foreign patents include the French Pat. No. 999,275 which discloses ships and "jetons" on a playing surface, and French Pat. No. 718,991 issued in 1931, discloses boards with co-ordinate grills screened from opponents and having different playing pieces similar to the game SALVO. A German Pat. No. 635,614 issued in 1936 discloses playing pieces shiftably captured between pairs of boards. None of these reference devices include discrete platforms disposable on the boards to represent land masses with multi-target capacity or the concept of display of the "hit" targets or any land-sea differentiation means. There is a place and need for such game apparatus.

SUMMARY OF THE INVENTION

As claimed, the instant invention meets the immediately abovementioned need for a land and sea war game wherein platforms realistically represent land masses of various sizes and configurations, along with board areas representing expanses of sea, and with accessories including playing piece targets, markers and a spinner particularly related to the bi-element, land and sea differentiation in the apparatus and reflected in the manner of playing the game.

BRIEF DESCRIPTION OF THE DRAWING

FIG. 1 is an isosmetric view of the combined playboard, playing piece targets storage bins, and visual shield board incorporatng a rack for "hit" targets;

FIG. 2 a collective view of playing pieces and a special spinner used in playing the game;

DETAILED DESCRIPTION OF A PREFERRED EMBODIMENT

Figure 3:
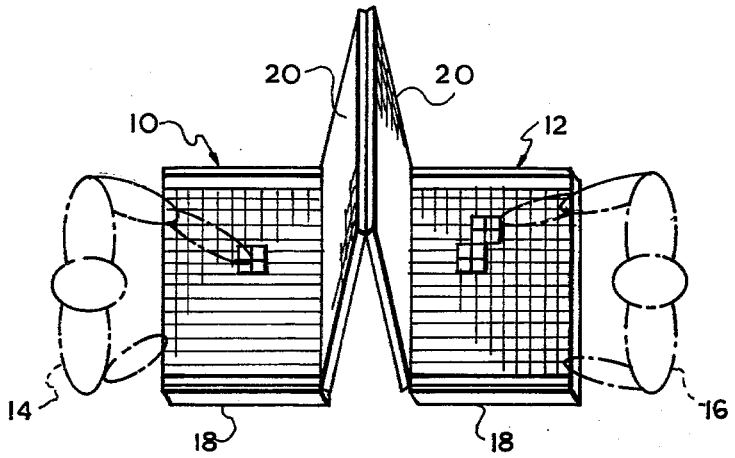
FIG. 3 is a diagrammatic view of two playboard-shield board assemblies positioned as in use with opposing players indicated.
Figure 4:
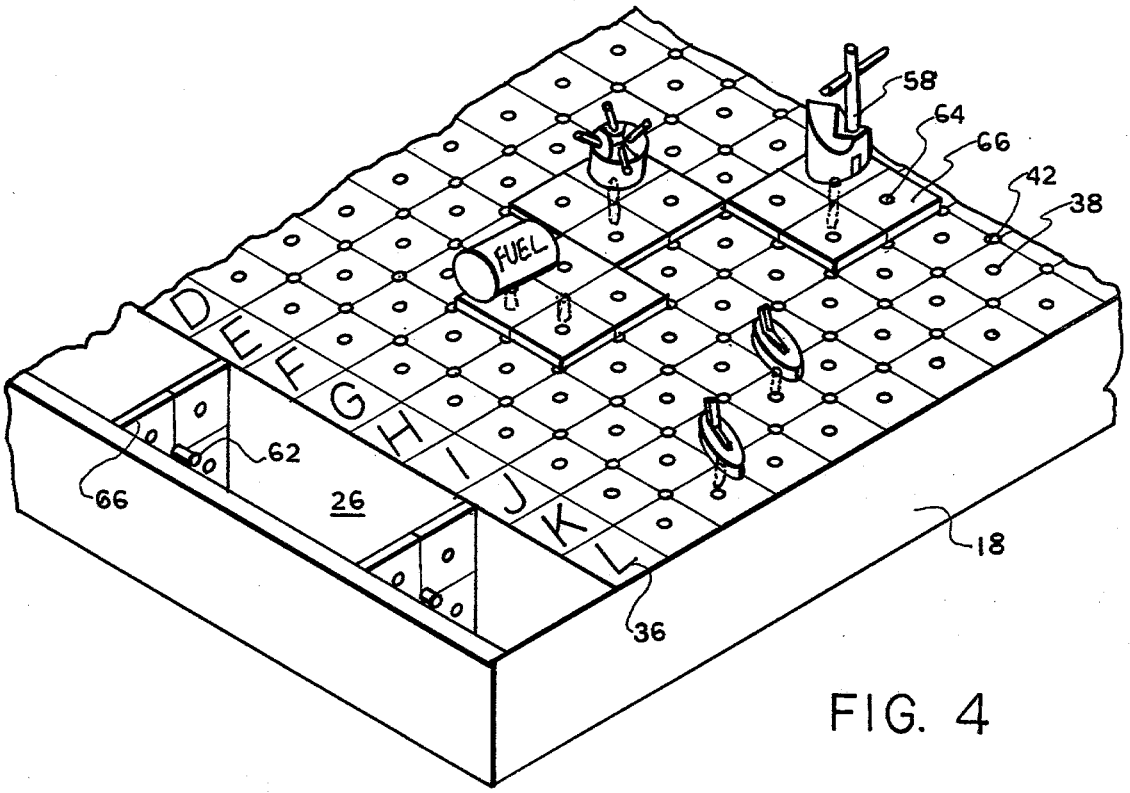
FIG. 4 is a fragmentary isometric view showing a corner portion of a playboard.

Referring now to the drawing wherein like numerals refer to identical or similar parts and portions throughout the several views, the apparatus comprises two identical assemblies 10, 12, diagrammatically indicated in FIG. 1 for use by opposing players 14 and 16 also indicated in the same figure. Each assembly 10 and 12 includes a combined playboard 18 and a shield board 20 secured thereto, as by hinges 22 or the like, so that the shield boards can be disposed in near upright position between the players, thus serving to visually screen each playboard from the opposing player, the shield boards 20 being held in such position preferably by a link, strap or chain 24. Each playboard 18 has one or more target playing-piece storage bins 26 at the side or sides of the playboard and these bins may be compartmented as indicated at 28.

The playboards 18 and shield boards 20 are provided with grids 30 and 32, respectively, and these grids are similar in having identical alphabetic and numerical co-ordinates at corresponding edges of the boards as indicated at 34 and 36. In addition, both boards 18 and 20 have what will be denominated center sockets 38 and 40 at the center of each square defined by the grid lines on the boards 18 and 20, respectively. The playboards differ from the shield boards in one important respect, namely, the playboards have additional sockets herein called intersection sockets 42. Furthermore, the shield boards 20 each have a rack comprising comparable sockets 44 which will be referred to as hit target sockets 44 or the equivalent along the edge 46 of the shield board, the functions of said sockets 38, 40, 42 and 44 will now be explained.

Each of said assemblies 10 and 12 also includes a set of elements grouped in FIG. 1. This set comprises playing piece target simulating elements which will be referred to simply as targets, such as a water tank 48, fuel tank 50, warship 52, tank 54 and machine gun nest 56, as well as what may be referred to as penalty targets or non-targets such as a simulated church 58 and hospital 60. Each target has a portion, illustrated as a spike 62, whereby the target can be arbitrarily positioned in any center socket 38 in the playboard or any socket 64 in the land masses 66 which will now be described.

An important feature of this invention is the provision of one or more playing pieces which are identified as land masses 66. These land masses each are dimensioned and shaped to cover a plurality of squares of the grid 30 and each land mass has a portion, illustrated as a spike 68, for insertion in one of the intersection sockets 42. As shown the land masses have four squares corresponding dimensionally with the squares of the grids, and sockets 64 are disposed centrally of each square on the land mass. It follows that when the land mass or masses are mounted on the playboard by their spikes 68 the squares on the land masses may register exactly with the squares of the grid therebeneath. If one or more of said targets and/or non-targets are mounted on said land mass or masses, by inserting the spikes 62 in the land mass sockets 64, then these targets and non-targets are co-ordinately identifiable on the grid of the playboard.

Means to assure accurately identifiable co-ordinate orientation of the land masses and targets thereon may take the form of spikes 68, being non-circular in cross section and the intersection sockets 42 being correspondingly shaped, thus preventing the land masses from being mounted on the playboard in positions other than in proper alignment with the grid thereon.

Finally, each of said assemblies 10 and 12 may include a pair of dice 70 and a unique spinner disc 77 having a manually spun pointer 74. The spinner disc 77 has a plurality of dial spaces, demarked to represent an equal number of bi-element, land and sea, locations when the pointer 74 is spun by a player. These dial spaces may be of contrasting, brown and blue coloration to represent land and sea. Differently colored pegs 76 are used by each player to record, on his shield board, each hit and/or miss he calls on his opponent's playboard, and he may use these pegs to mark the hits and/or misses made by his opponent on his own playboard.

While the rules of the game and the manner of playing may not be patentable a brief description of the functioning of the apparatus in use, that is, in play, may aid in rationalizing the structural concepts involved in this invention. A number of different games may be played using the hereindisclosed equipment. The concept of physically, arbitrarily defining certain areas of the playboard as land masses by placement of the elements 66 in a desired pattern, as distinct from the remainder of the playboard identified as sea, especially when combined with the landsea indicating spinner 77-74, enables playing of games with penalties and premiums for random and/or logically determined "shots" by the players, it being presumed that most games played with this apparatus will be contests between opposing players 14 and 16 calling shots against opponent's targets on playboards hidden from view by the shield boards 20. In starting a game, the dice may be rolled by each player to determine which player first makes the hypothetical shot, and the dice and spinner will be in full view of the opponent. The rack of hit target sockets 44 on each shield board enables each play to notify his opponent of any hits made by his opponent, by simply placing the hit target in one of the sockets 44 in full view of the opponent. Score sheets can be used to calculate scores according to predetermined value and penalty scales. The differently colored pegs 76 will be used, in most games, to record hits and/or misses on the boards as the game proceeds. Analysis of the pattern of these pegs 76 will help a skillful player to develop a strategy of play, subject to the rules of the game, thus heightening the interest and pleasure in the play. The spinner has randomly arranged numerals and can be used to determine how many "shots" each player may call when it is his turn to "fire" hypothetical shots at his opponent's targets. The coloration of the land masses 66 is preferably brown and the playboard is preferably blue and this color code is carried into the spinner spaces as mentioned above, this matching of colors psychologically linking the spinner with the playboard with respect to the land-sea concept. A peg fork 78 as illustrated in FIG. 2 has three or four opposing prongs 80 at one end thereof and the players use these forks to pick up individual pegs 76, this fork being especially helpful in retrieving a single peg 76 from a compartmented bin 28.

What I claim as new and desire to secure by letters patent is:

1. Land and sea war game apparatus of the type whereby opposing players in turn launch hypothetical missiles to attempt hits upon targets on an opponent's playboard, said apparatus comprising:

(a) a pair of identical assemblies each including a playboard, horizontal in use, with a visual shield board connected to the playboard and disposable in upstanding position between the players, said playboard and shield board having intersecting grid lines with equally spaced co-ordinately identified center sockets at the centers of the squares defined by the grid lines;

(b) said playboard having additional intersection sockets at the intersections of said grid lines;

(c) playing piece targets having portions removably insertable in said center sockets; and (d) multiple targets-supporting platforms each having a portion insertable selectively in said intersection sockets, said platforms having means for arbitrarily mounting a plurality of targets over a plurality of said squares so that the targets on said platforms may be co-ordinately identified and distinguished from targets not on said platforms, whereby the board has bi-element, land and sea character with said platforms representing land masses on a sea represented by areas of the playboard not covered by said platforms, in the playing of sea and land war games and the like.

2. Apparatus according to claim 1 and including means for positive orienting of the platforms on the playboard so that targets arbitrarily mounted on the platforms will be accurately registered with co-ordinately identified squares on said playboard.

3. Apparatus according to claim 2 wherein said intersection sockets and said portions selectively insertable therein are of corresponding non-circular cross sectional configuration and oriented with respect to said grid and platforms, respectively, to assure said positive orienting of the platforms.

4. Apparatus according to claim 1 and including a rack to display targets hypothetically hit by an opponent so as to be visible by said opponent.

5. Apparatus according to claim 2 wherein said rack is disposed on the top of said shield board.

6. Apparatus according to claim 1 and wherein certain of said playing piece targets are configured to represent internationally accepted non-targets.

7. Apparatus according to claim 1 and including a spinner having distinguishing, alternating dial spaces capable of being particularly and visually related to said bi-element, land and sea, character of the playing board.

8. Apparatus according to claim 1 and including hit and miss recording pegs insertable in said center sockets and a peg handling fork for picking up said pegs individually, said fork comprising an elongated pencil-like element having at one end thereof at least three opposing furcations to resiliently and releasibly grasp said pegs.

* * * * *